US011421414B2

(12) United States Patent
Zhou et al.

(10) Patent No.: US 11,421,414 B2
(45) Date of Patent: Aug. 23, 2022

(54) CONCRETE-FILLED STEEL TUBULAR COLUMN-STEEL PLATE CONCRETE RING BEAM JOINT AND CONSTRUCTION METHOD THEREOF

(71) Applicant: South China University of Technology, Guangzhou (CN)

(72) Inventors: Jing Zhou, Guangzhou (CN); Xiaodan Fang, Guangzhou (CN)

(73) Assignee: South China University of Technology, Guangzhou (CN)

( * ) Notice: Subject to any disclaimer, the term of this patent is extended or adjusted under 35 U.S.C. 154(b) by 496 days.

(21) Appl. No.: 16/474,276

(22) PCT Filed: May 22, 2018

(86) PCT No.: PCT/CN2018/087746
§ 371 (c)(1),
(2) Date: Jun. 27, 2019

(87) PCT Pub. No.: WO2019/210537
PCT Pub. Date: Nov. 7, 2019

(65) Prior Publication Data

US 2021/0340750 A1 Nov. 4, 2021

(30) Foreign Application Priority Data

May 2, 2018 (CN) ..... 201810408199.X

(51) Int. Cl.
*E04B 1/30* (2006.01)
*E04B 1/18* (2006.01)

(52) U.S. Cl.
CPC ..... *E04B 1/185* (2013.01); *E04B 1/30* (2013.01)

(58) Field of Classification Search
CPC ..... E04C 3/34; E04C 3/293; E04C 5/0604; E02D 27/425; E04B 1/30; E04B 1/185
See application file for complete search history.

(56) References Cited

U.S. PATENT DOCUMENTS 1,804,320 A * 5/1931 Cross ..... E04C 3/36 52/249
10,378,208 B2 * 8/2019 Sun ..... E04C 3/36
(Continued)

FOREIGN PATENT DOCUMENTS

CN 1560393 A 1/2005
CN 101457548 A 6/2009
(Continued)

*Primary Examiner* — Brian E Glessner
*Assistant Examiner* — Daniel J Kenny
(74) *Attorney, Agent, or Firm* — The Dobrusin Law Firm, PC

(57) ABSTRACT

The present invention relates to a concrete-filled steel tubular column-steel plate concrete ring beam joint, comprising: a concrete-filled steel tubular column, a steel plate concrete ring beam and reinforced concrete frame beams. The steel plate concrete ring beam comprises: a steel plate and a reinforcing cage, wherein concrete grouting holes are arranged in the middle of the steel plate; both the steel plate and the reinforcing cage are of a ring shape, and the ring-shaped steel plate and the reinforcing cage are coaxially arranged; the steel plate concrete ring beam is sheathed and fixed on the outer side wall of the concrete-filled steel tubular column; and an end of the reinforced concrete frame beam extends into the steel plate concrete ring beam, and stressed reinforcements of the reinforced concrete frame beam are connected to the steel plates. The steel plate concrete ring beam is of a centrosymmetric ring-shaped or eccentric ring-shaped construction. The stressed reinforcement of the reinforced concrete frame beam is anchored by the ring beam joint through the steel plates, so that the (Continued)

seismic performance of the connection joint is ensured, the section width of the steel plate concrete ring beam can be significantly reduced, and the spatial applicability of the joint is improved. The present invention also relates to a construction method of a concrete-filled steel tubular column-steel plate concrete ring beam joint, belonging to the field of building structures.

8 Claims, 4 Drawing Sheets

(56) References Cited

U.S. PATENT DOCUMENTS

| | | | | |
|---|---|---|---|---|
| 10,724,204 | B2 * | 7/2020 | Schuldt | F03D 13/20 |
| 10,738,436 | B1 * | 8/2020 | Wang | E02D 27/425 |
| 2005/0050837 | A1 * | 3/2005 | Wang | E04C 5/0604 52/600 |
| 2006/0070338 | A1 * | 4/2006 | Pantelides | E04C 3/34 52/847 |
| 2009/0120025 | A1 * | 5/2009 | Sezen | E04C 5/0604 52/340 |
| 2009/0282753 | A1 * | 11/2009 | Kuan | E04C 5/0609 52/167.1 |
| 2012/0124937 | A1 * | 5/2012 | Teng | E04B 5/43 52/834 |

FOREIGN PATENT DOCUMENTS

| | | | |
|---|---|---|---|
| CN | 201605670 | U | 10/2010 |
| JP | 2008019614 | A | 1/2008 |
| JP | 2009280971 | A | 12/2009 |

* cited by examiner

CONCRETE-FILLED STEEL TUBULAR COLUMN-STEEL PLATE CONCRETE RING BEAM JOINT AND CONSTRUCTION METHOD THEREOF

TECHNICAL FIELD

The present invention relates to the field of building structures, and in particular to a concrete-filled steel tubular column-steel plate concrete ring beam joint and construction method thereof.

BACKGROUND ART

Concrete-filled steel tubular members are internationally recognized structural carrying elements with higher structural efficiency and stronger spanning capacity, complying with the current development trend of green and energy-saving industries. The connection technology of a concrete-filled steel tubular column-reinforced concrete frame beam is one of the key technologies to ensure the overall robustness, seismic performance and construction efficiency of a concrete-filled steel tubular frame structure. However, there are still some technical problems that can be improved in the concrete-filled steel tubular column-concrete ring beam connection joint itself or its application in engineering practices. Although the concrete-filled steel tubular column-concrete ring beam connection joint has a high flexural capacity, shear bearing capacity and good seismic performance, the ring beam section width is usually large due to the structure requirement that the anchoring length of the stressed reinforcements from a frame beam extending into a ring beam is not less than the seismic anchoring length ($l_{aE}$). Wide and thick concrete ring beams affect the use of a building space, with limitations in the use of edge joints and partial door and window opening positions of the frame structure, the difficulty in manufacturing, construction and installation is thus increased, and the cost of joints is directly increased. In addition, the concrete ring beam is usually designed in a symmetrical form centered on the concrete-filled steel tubular column; however, for a large eccentric joint (such as a corner column and a side column) where the frame beam connected to the concrete ring beam is biased towards one side, there is a limitation in the application of the centrosymmetric concrete ring beam, the stress is not very reasonable and the other side without the beam is too wasteful.

SUMMARY OF THE INVENTION

In view of the technical problems existing in the prior art, an object of the present invention is: to provide a concrete-filled steel tubular column-steel plate concrete ring beam joint. A steel plate construction is added to the ring beam joint to ensure the seismic performance of the connection joint, and the section width of the steel plate concrete ring beam can be significantly reduced.

Another object of the present invention is to provide a construction method of a concrete-filled steel tubular column-steel plate concrete ring beam joint. The construction method is simple and can reduce the amount of on-site workload for the joint and improve the level of industrial construction.

In order to achieve the above-mentioned object, the present invention uses the following technical solution:

a concrete-filled steel tubular column-steel plate concrete ring beam joint, comprising: a concrete-filled steel tubular column, a steel plate concrete ring beam and reinforced concrete frame beams, wherein the steel plate concrete ring beam comprises: a steel plate, a reinforcing cage and concrete; the steel plate is I-shaped, and concrete grouting holes are arranged in the middle of the steel plate; both the steel plate and the reinforcing cage are of a ring shape, and the ring-shaped steel plate and the reinforcing cage are coaxially arranged; the steel plate concrete ring beam is sheathed and fixed on the outer side wall of the concrete-filled steel tubular column; and an end of the reinforced concrete frame beam extends into the steel plate concrete ring beam, and stressed reinforcements of the reinforced concrete frame beam are connected to the steel plates. With this structure, the steel plates are arranged inside the reinforcing cage, and the stressed reinforcements of the reinforced concrete frame beam are connected to the steel plates, so that the joint space can be greatly optimized while the seismic performance and the bearing capacity of the connection joint are guaranteed, and the section width of the steel plate concrete ring beam is reduced.

Preferably, the steel plate concrete ring beam is of a centrosymmetric ring shape, and the reinforced concrete frame beam is circumferentially arranged along the steel plate concrete ring beam. With this structure, the steel plate concrete ring beam of a centrosymmetric ring shape is symmetrical in structure, uniform in stress, and safe and reliable.

Preferably, the steel plate concrete ring beam is of an eccentric ring shape, and the reinforced concrete frame beam is arranged along an eccentric side of the steel plate concrete ring beam. With this structure, it is more applicable for the large eccentric joints where the reinforced concrete frame beam connected to the steel plate concrete ring beam is biased towards one side, and the stress is reasonable.

Preferably, the stressed reinforcements of the reinforced concrete frame beam pass through the steel plates and are connected to same, and the end of the stressed reinforcement that passes through the steel plate is provided with an external thread, an outer side of which is sheathed with a nut. With this structure, the stressed reinforcement is anchored with the steel plate by a nut, so that the stressed reinforcement of the reinforced concrete frame beam can be of reliable seismic anchoring, and can be safe and reliable with a simple connection mode.

Preferably, the reinforcing cage comprises several circumferential reinforcements and several radial stirrups, the circumferential reinforcements comprise an inner row of circumferential reinforcements and an outer row of circumferential reinforcements which are coaxially arranged, the inner row of circumferential reinforcements and the outer row of circumferential reinforcements which are positioned in the same horizontal plane are a group of circumferential reinforcements, and at least two groups of circumferential reinforcements are distributed along the axial direction of the circumferential reinforcements; and several radial stirrups are radially sheathed outside the circumferential reinforcements. With this structure, the flexural capacity, shear capacity and seismic capacity of the steel plate concrete ring beam can be effectively improved.

Preferably, at least one shear ring reinforcement is arranged within the section height of the steel plate concrete ring beam on the outer side wall of the concrete-filled steel tubular column, and the shear ring reinforcement is pasted and welded on the outer side wall of the concrete-filled steel tubular column; and when the height of the steel plate concrete ring beam is greater than 450 mm, one circumferential waist reinforcement is arranged in the inner row and the outer row of the reinforcing cage, and the diameter of the circumferential waist reinforcement is greater than or equal to 12 mm. With this structure, bond-slip between the steel plate concrete ring beam and the outer wall of the concrete-filled steel tubular column can be effectively inhibited.

Preferably, the spacing between the steel plate and the outer row of circumferential reinforcement is greater than or equal to 25 mm. With this structure, the ring beam joint is ensured to meet the lowest seismic performance requirement.

Preferably, the height of the steel plate concrete ring beam is greater than the height of the reinforced concrete frame beam, and the width of the steel plate concrete ring beam is greater than or equal to 150 mm. With this structure, it is convenient for the steel plate concrete ring beam to reliably transfer an internal force of a beam end of the reinforced concrete frame beam, ensuring the ring beam joint to meet the lowest seismic performance requirement.

A construction method of a concrete-filled steel tubular column-steel plate concrete ring beam joint comprises the following steps:

S1: determining a section size of a steel plate concrete ring beam, a steel plate size, and the diameter, the number and a spacing of a circumferential reinforcement and a radial stirrup, and tapping an end of a stressed reinforcement of a reinforced concrete frame beam to obtain an external thread; S2: processing the steel plate to be annular, perforating in advance at a position on the steel plate corresponding to the extension of the stressed reinforcement of the reinforced concrete frame beam, and arranging concrete grouting holes in the middle of the steel plate; S3: manufacturing a steel plate-reinforcing cage; S4: pouring concrete into a steel tube to form a concrete-filled steel tubular column, and pasting and welding shear ring reinforcements on the outer wall of the concrete-filled steel tubular column; S5: manufacturing a formwork of the steel plate concrete ring beam and a formwork of the reinforced concrete frame beam on site, and hoisting the steel plate-reinforcing cage manufactured in step S3 into the formwork of the steel plate concrete ring beam for positioning and fixing; S6: extending the stressed reinforcement of the reinforced concrete frame beam into the reinforcing cage, passing through a preset opening on the steel plate, screwing the nut in conjunction with the external thread of the stressed reinforcement, and anchoring the stressed reinforcement on the steel plate; and S7: pouring concrete into the formwork of the steel plate concrete ring beam and the formwork of the reinforced concrete frame beam to form an integral rigid ring beam joint.

Preferably, in step S6, the length of the external thread tapped at the end of the stressed reinforcement is at least 50 mm. With this structure, the reliable anchoring of the stressed reinforcement can be ensured, and the seismic performance requirement can be met.

The principle of the present invention is that steel plates are added in a conventional reinforced concrete ring beam to obtain a steel plate concrete ring beam, and the shape of the steel plate is similar to that of the steel plate concrete ring beam. When the reinforced concrete frame beam is connected to the steel plate concrete ring beam, the stressed reinforcement of the reinforced concrete frame beam passes through the steel plate of the steel plate concrete ring beam, the external thread is tapped on a part where the stressed reinforcement passes through the steel plate, and a nut is used to connect with the external thread to realize an seismic anchoring connection of the stressed reinforcement and the steel plate, thereby solving the structure requirement that the anchoring length of the stressed reinforcement of the reinforced concrete frame beam extending into the steel plate concrete ring beam is not less than the seismic anchoring length ($l_{aE}$). Thus, the section width of the steel plate concrete ring beam is reduced.

In general, the present invention has the following advantages:

1. The advantages of a simple structure, mechanical properties, construction technology and low costs of the existing concrete-filled steel tubular column-steel plate concrete ring beam joint are retained; there is no through-core member and stiffened ring plate in the steel tube; the section of the steel tubular column is not weakened; the steel plate concrete ring beam can reasonably and reliably transfer bending moment and shear force at a beam end, with a high safety margin for the bearing capacity; and the seismic performance is good, and an seismic design principle of "strong joint and weak member" is fully guaranteed.

2. The joint is simple in structure, flexible in arrangement and clear in stress, and the steel plate is used to anchor the stressed reinforcement of the reinforced concrete frame beam, which successfully solves the structure constraint of the minimum seismic anchoring length of the stressed reinforcement in the steel plate concrete ring beam and can significantly reduce the section width of the steel plate concrete ring beam.

3. For a large eccentric stressed joint such as a corner column and a side column where the beam end of the reinforced concrete frame beam connected to the steel plate concrete ring beam is biased towards one side of a column edge, and the joints restricted by the openings of building doors and windows, an eccentric steel plate concrete ring beam form (such as an oval ring beam) is used to achieve a safer and more reasonable stress and a higher space adaptability.

4. The steel plate is arranged in the steel plate concrete ring beam, which can reduce the number of circumferential reinforcements and radial stirrups, and reduce the difficulty in manufacturing a reinforcing cage.

5. The section width of the steel plate concrete ring beam is significantly reduced, which not only improves the spatial adaptability of the joint, but also reduces the difficulty in manufacturing, construction and installation of the ring beam joint, and also saves the costs.

6. The steel plate-reinforcing cage can be manufactured in large scale in advance in the factory, and can be produced in uniform standards for different beam-column sections with high production accuracy, easy quality control and resource saving; and the steel plate-reinforcing cage can be transported to the site for hoisting, which can reduce the amount of on-site workload for the joint and improve the level of industrial construction.

The numbers in the figures and the names of the corresponding components are: 1 Concrete-filled steel tubular column, 2 Steel plate concrete ring beam, 3 Reinforced concrete frame beam, 4 Shear ring reinforcement, 5 Inner row of circumferential reinforcement, 6 Outer row of circumferential reinforcement, 7 Radial stirrup, 8 Steel plate, 9 Nut, 10 Stirrup of reinforced concrete frame beam, 11 Stressed reinforcement, 12 Concrete grouting hole. In the figures, b represents the width of the steel plate concrete ring beam, $b_1$ represents the distance from a lower shear ring reinforcement to the bottom surface of the steel plate concrete ring beam, $b_2$ represents the distance from an upper shear ring reinforcement to the bottom surface of the steel plate concrete ring beam, $b_3$ represents the height difference between the steel plate concrete ring beam and the reinforced concrete frame beam, and h represents the height of the steel plate concrete ring beam.

DETAILED DESCRIPTION OF EMBODIMENTS

The present invention will be described in further detail below with reference to the accompanying drawings.

Embodiment 1

Figure 1:
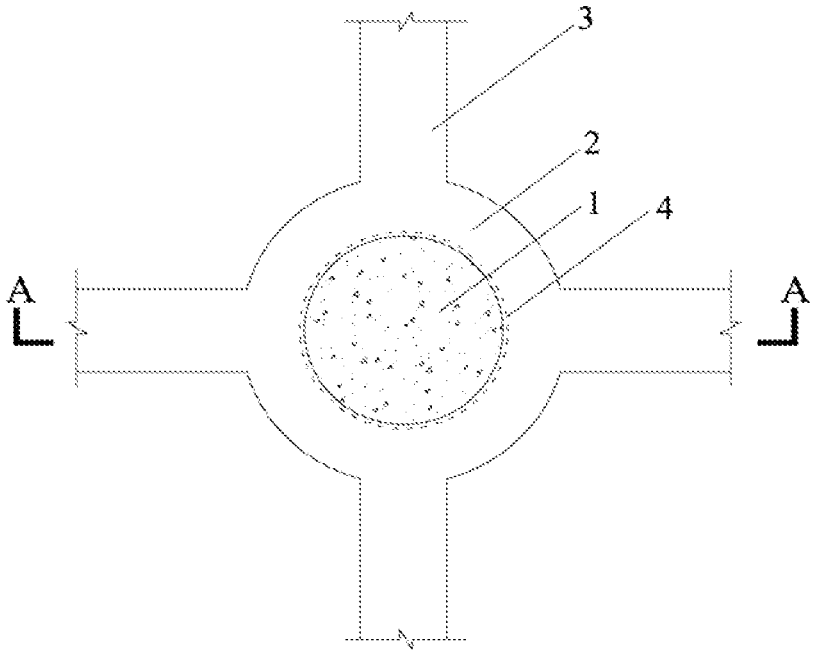
FIG. 1 is a top view of a steel plate concrete ring beam of a centrosymmetric ring shape.
Figure 2:
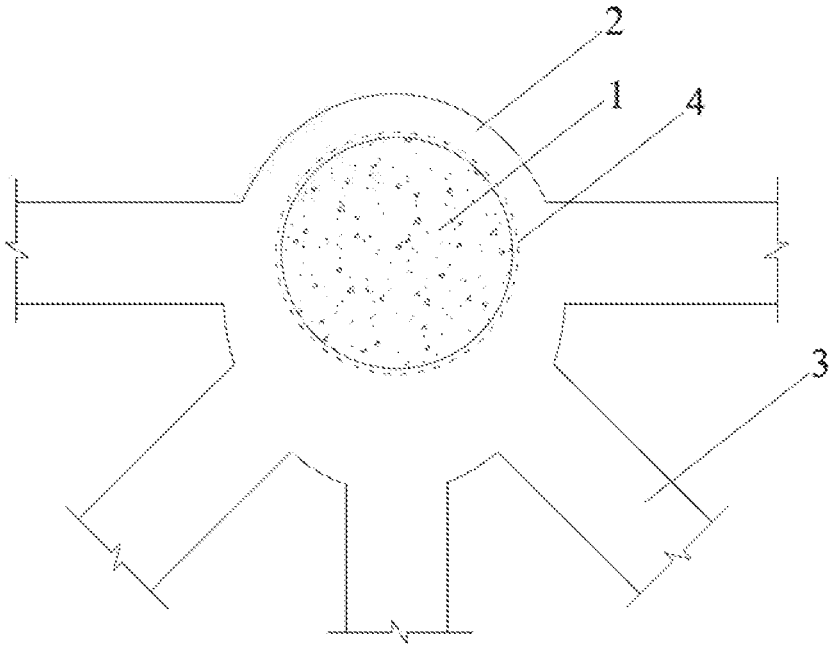
FIG. 2 is a top view of a steel plate concrete ring beam of an eccentric ring shape.
Figure 3:
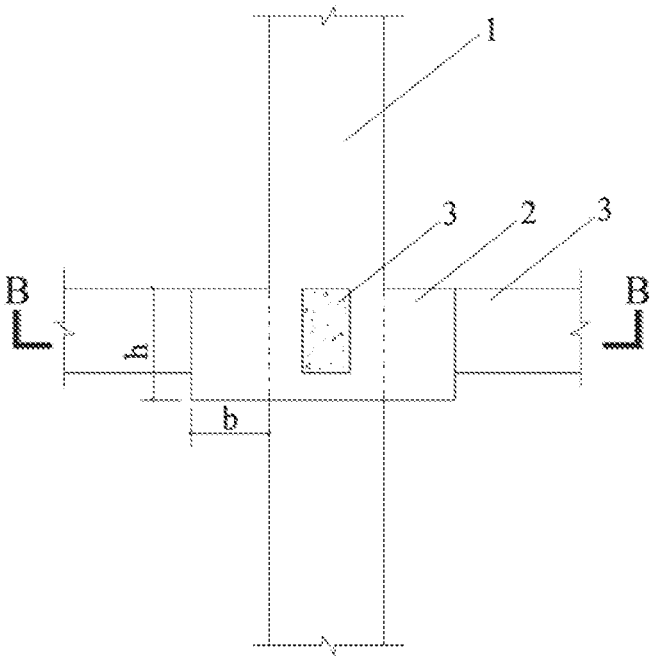
FIG. 3 is a front view of FIG. 1.
Figure 4:
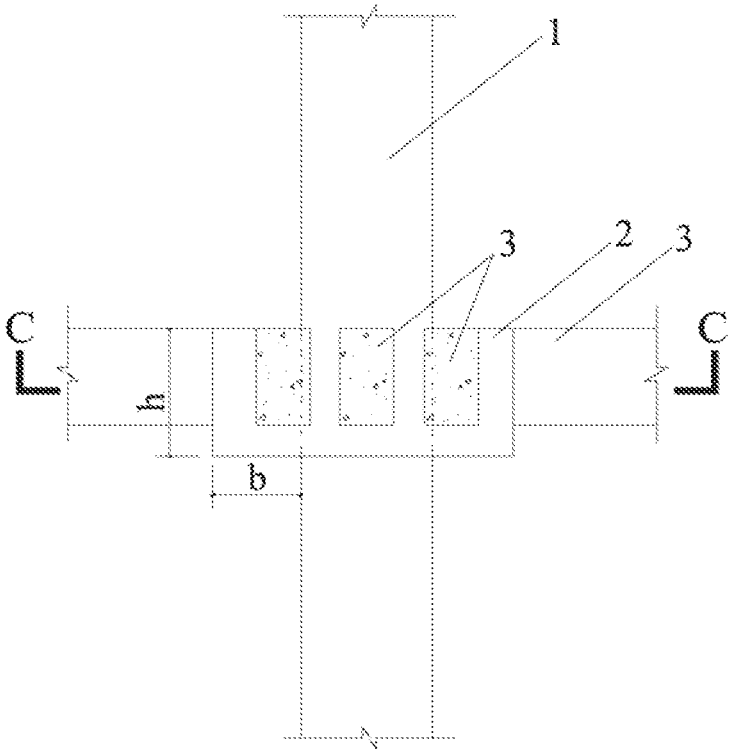
FIG. 4 is a front view of FIG. 2.
Figure 5:
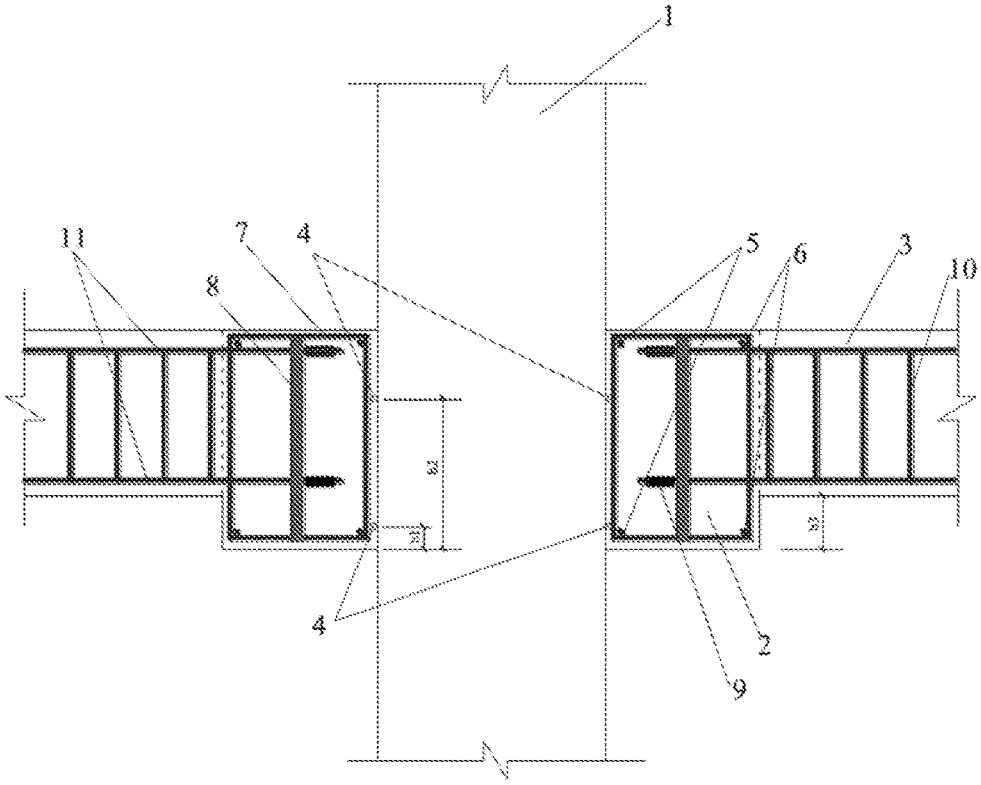
FIG. 5 is a structural schematic diagram of section A-A of FIG. 1.
Figure 6:
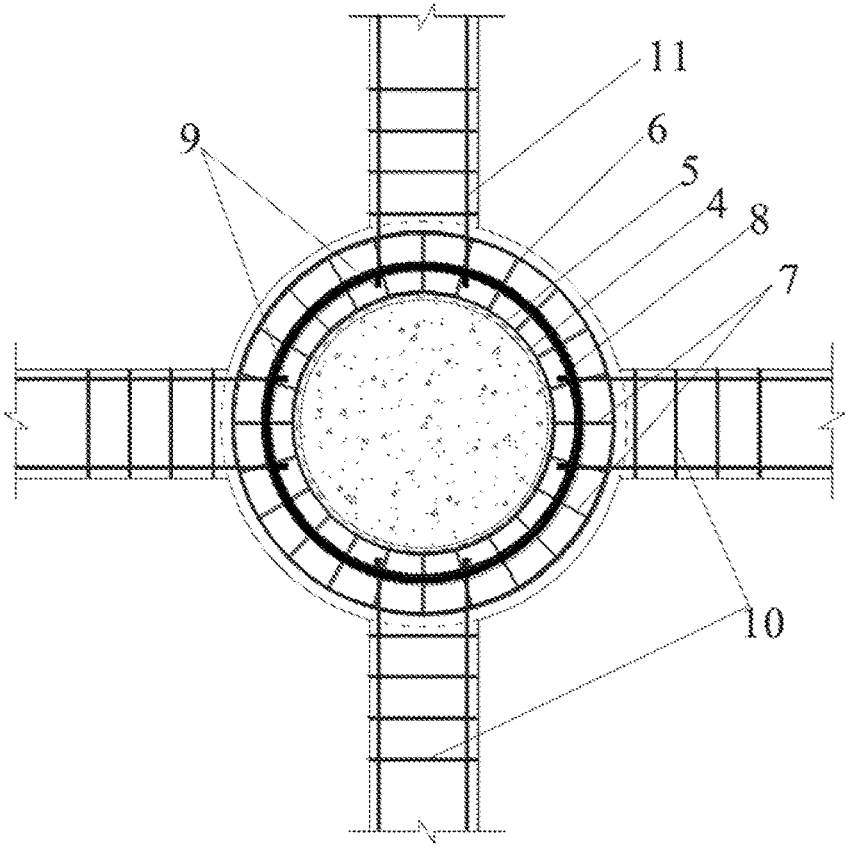
FIG. 6 is a structural schematic diagram of section B-B of FIG. 3.
Figure 7:
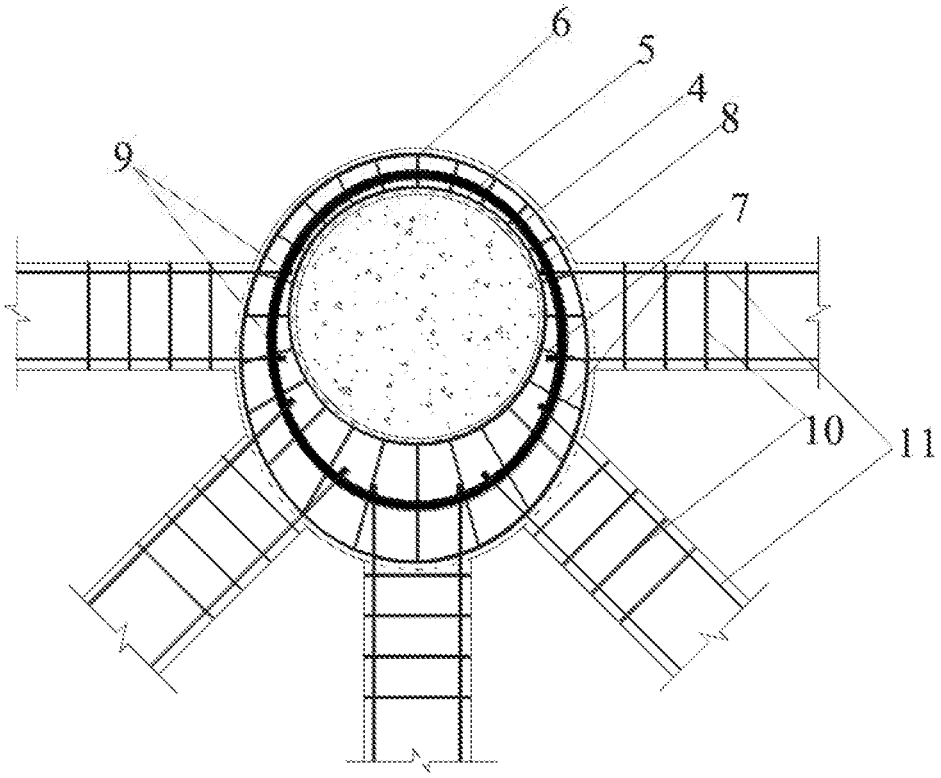
FIG. 7 is a structural schematic diagram of section C-C of FIG. 4.
Figure 8:
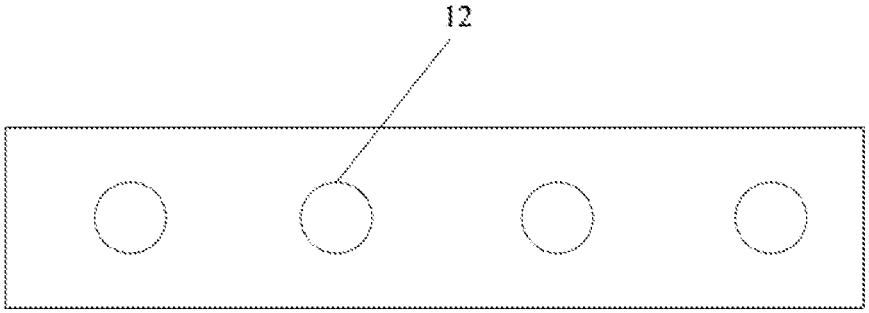
FIG. 8 is a schematic diagram of the extension of a steel plate with concrete grouting holes.

A concrete-filled steel tubular column-steel plate concrete ring beam joint comprises: a concrete-filled steel tubular column, a steel plate concrete ring beam of a centrosym metric ring shape, reinforced concrete frame beams, and shear ring reinforcements. The steel plate concrete ring beam comprises: an I-shaped steel plate, a reinforcing cage, and concrete. The steel plate is preset with holes through which the stressed reinforcement of the reinforced concrete frame beam passes and concrete grouting holes which are convenient for concrete to flow on both sides of the steel plate. As shown in FIG. 5 and FIG. 6, the shear ring reinforcements are pasted and welded to the upper and lower parts within the height of the steel plate concrete ring beam on the outer side wall of the concrete-filled steel tubular column. Shear ring reinforcements are used to inhibit the bond-slip between the steel plate concrete ring beam and the outer wall of the concrete-filled steel tubular column. The steel plate and the reinforcing cage are each of a centrosym metric ring shape, and the ring-shaped steel plate and the reinforcing cage are coaxially arranged. Steel plates are arranged inside the reinforcing cage, and the stressed reinforcements of the reinforced concrete frame beam are connected to the steel plates, so that the seismic requirements of the connection joints are met, the joint space can be greatly optimized, and the section width of the steel plate concrete ring beam is reduced.

The steel plate concrete ring beam is sheathed and fixed on the outer side wall of the concrete-filled steel tubular column; and the stressed reinforcements of the reinforced concrete frame beam pass through the steel plates and are connected to the steel plates, and is positioned outside the steel plate concrete ring beam. The stressed reinforcements of the reinforced concrete frame beam pass through the steel plates and are connected to same, and the end of the stressed reinforcement that passes through the steel plate is provided with an external thread, an outer side of which is sheathed with a nut. The stressed reinforcement is anchored with the steel plate by a nut, so that the seismic anchoring requirement of the stressed reinforcement is guaranteed, and the connection mode is simple, convenient, safe and reliable.

The reinforcing cage comprises several circumferential reinforcements and several radial stirrups, wherein the circumferential reinforcements comprise an inner row of circumferential reinforcements and an outer row of circumferential reinforcements which are coaxially arranged, the inner row of circumferential reinforcements and the outer row of circumferential reinforcements which are positioned in the same horizontal plane are a group of circumferential reinforcements, and at least two groups of circumferential reinforcements are distributed along the axial direction of the circumferential reinforcements; and several radial stirrups are radially sheathed outside the circumferential reinforcements. In this embodiment, two groups of circumferential reinforcements are provided along the axial direction of the circumferential reinforcements. The space between the steel plate and the outermost circumferential reinforcement in each group of circumferential reinforcements is taken as 30 mm. The height of the steel plate concrete ring beam is greater than the height of the reinforced concrete frame beam, and in this embodiment, the height of the steel plate concrete ring beam is taken as 500 mm, the height of the reinforced concrete frame beam is taken as 450 mm, and the diameter of the circumferential waist reinforcement is taken as 14 mm. The width of the steel plate concrete ring beam is not less than 150 mm, and when taken as 200 mm in this embodiment, which is convenient for the steel plate concrete ring beam to reliably transfer an internal force of a beam end of the reinforced concrete frame beam, ensuring the ring beam joint to meet the lowest seismic performance requirement.

A construction method of a concrete-filled steel tubular column-steel plate concrete ring beam joint comprises the following steps:

S1: computing and determining a section size of a steel plate concrete ring beam, a steel plate size, and the diameter, the number and a spacing of a circumferential reinforcement and a radial stirrup according to the stress at the joint, and tapping an end of a stressed reinforcement of a reinforced concrete frame beam to obtain an external thread, wherein the length of the external thread tapped at the end of the stressed reinforcement is at least 50 mm;

S2: processing the steel plate to be annular, perforating in advance at a position on the steel plate corresponding to the extension of the stressed reinforcement of the reinforced concrete frame beam, and arranging concrete grouting holes in the middle of the steel plate;

S3: manufacturing a steel plate-reinforcing cage;

S4: pouring concrete into a steel tube to form a concrete-filled steel tubular column, and pasting and welding shear ring reinforcements on the outer wall of the concrete-filled steel tubular column;

S5: manufacturing a formwork of the steel plate concrete ring beam and a formwork of the reinforced concrete frame beam on site, and hoisting the steel plate-reinforcing cage manufactured in step S3 into the formwork of the steel plate concrete ring beam for positioning and fixing;

S6: extending the stressed reinforcement of the reinforced concrete frame beam into the reinforcing cage, passing through a preset opening on the steel plate, screwing the nut in conjunction with the external thread of the stressed reinforcement, and anchoring the stressed reinforcement on the steel plate; and

S7: pouring concrete into the formwork of the steel plate concrete ring beam and the formwork of the reinforced concrete frame beam to form an integral rigid ring beam joint.

Embodiment 2

The steel plate concrete ring beam is of an eccentric ring shape, and a steel plate and a reinforcing cage each are of an eccentric ring shape. The steel plate-reinforcing cage is prefabricated. The steel plate concrete ring beam of an eccentric ring shape is more applicable for the large eccentric joint where the frame beam connected to the steel plate concrete ring beam is biased towards one side, and the stress is reasonable.

The parts not mentioned in this embodiment are the same as those in embodiment 1, and will not be described here again.

The above-described embodiments are preferred embodiments of the present invention; however, the embodiments of the present invention are not limited to the above-described embodiments, and any other change, modification, replacement, combination, and simplification made without departing from the spirit, essence, and principle of the present invention should be an equivalent replacement and should be included within the scope of protection of the present invention.

The invention claimed is:

1. A concrete-filled steel tubular column-steel plate concrete ring beam joint, comprising: a concrete-filled steel tubular column, a steel plate concrete ring beam and a plurality of reinforced concrete frame beams arranged outside the steel plate concrete ring beam, wherein the steel plate concrete ring beam comprises: a steel plate, a reinforcing bar cage and concrete; the steel plate is arranged inside the reinforcing bar cage; concrete grouting holes are arranged in the middle of the steel plate; both the steel plate and the reinforcing bar cage are of a ring shape, and the steel plate and the reinforcing bar cage are coaxially arranged;

the steel plate concrete ring beam is fixed on an outer side wall of the concrete-filled steel tubular column; and an end of the reinforced concrete frame beam extends into the steel plate concrete ring beam, and a stressed reinforcement of the reinforced concrete frame beam is anchored with steel plates by a nut;

wherein the steel plate concrete ring beam is of a centrosymmetric ring shape, and the plurality of reinforced concrete frame beams are circumferentially arranged along the steel plate concrete ring beam; or wherein the steel plate concrete ring beams is of an eccentric ring shape, and the plurality of reinforced concrete frame beams are arranged along an eccentric side of the steel plate concrete ring beam, and the plurality of reinforced concrete frame beams are biased towards one side of the concrete-filled steel tubular column.

2. The concrete-filled steel tubular column-steel plate concrete ring beam joint according to claim 1, wherein the stressed reinforcements of the reinforced concrete frame beam pass through the steel plates and are connected to same, and the end of the stressed reinforcement that passes through the steel plate is provided with an external thread, an outer side of which is sheathed with the nut.

3. The concrete-filled steel tubular column-steel plate concrete ring beam joint according to claim 1, wherein the reinforcing bar cage comprises several circumferential reinforcements and several radial stirrups, the circumferential reinforcements comprise an inner row of circumferential reinforcements and an outer row of circumferential reinforcements which are coaxially arranged, the inner row of circumferential reinforcements and the outer row of circumferential reinforcements which are positioned in the same horizontal plane are a group of circumferential reinforcements, and at least two groups of circumferential reinforcements are distributed along the axial direction of the circumferential reinforcements; and several radial stirrups are radially placed outside the circumferential reinforcements.

4. The concrete-filled steel tubular column-steel plate concrete ring beam joint according to claim 3, wherein the spacing between the steel plate and the outer row of circumferential reinforcement is greater than or equal to 25 mm.

5. The concrete-filled steel tubular column-steel plate concrete ring beam joint according to claim 1, wherein at least one shear ring reinforcement is arranged within the section height of the steel plate concrete ring beam on the outer side wall of the concrete-filled steel tubular column, and the shear ring reinforcement is welded on the outer side wall of the concrete-filled steel tubular column; and when the height of the steel plate concrete ring beam is greater than 450 mm, one circumferential waist reinforcement is arranged in the inner row and the outer row of the reinforcing bar cage, and the diameter of the circumferential waist reinforcement is greater than or equal to 12 mm.

6. The concrete-filled steel tubular column-steel plate concrete ring beam joint according to claim 1, wherein the height of the steel plate concrete ring beam is greater than the height of the reinforced concrete frame beam, and the width of the steel plate concrete ring beam is greater than or equal to 150 mm.

7. A construction method of the concrete-filled steel tubular column-steel plate concrete ring beam joint according to claim 1, wherein the method comprises the steps of:

S1: determining a section size of a steel plate concrete ring beam, a steel plate size, and the diameter, the number and a spacing of a circumferential reinforcement and a radial stirrup, and tapping an end of a stressed reinforcement of a reinforced concrete frame beam to obtain an external thread;

S2: processing the steel plate to be annular, perforating in advance at a position on the steel plate corresponding to the extension of the stressed reinforcement of the reinforced concrete frame beam, and arranging concrete grouting holes in the middle of the steel plate;

S3: manufacturing a steel plate-reinforcing bar cage;

S4: pouring concrete into a steel tube to form a concrete-filled steel tubular column, and pasting and welding shear ring reinforcements on the outer wall of the concrete-filled steel tubular column;

S5: manufacturing a formwork of the steel plate concrete ring beam and a formwork of the reinforced concrete frame beam on site, and hoisting the steel plate-reinforcing bar cage manufactured in step S3 into the formwork of the steel plate concrete ring beam for positioning and fixing;

S6: extending the stressed reinforcement of the reinforced concrete frame beam into the reinforcing bar cage, passing through a preset opening on the steel plate, screwing the nut in conjunction with the external thread of the stressed reinforcement, and anchoring the stressed reinforcement on the steel plate; and S7: pouring concrete into the formwork of the steel plate concrete ring beam and the formwork of the reinforced concrete frame beam to form an integral rigid ring beam joint.

8. The construction method of the concrete-filled steel tubular column-steel plate concrete ring beam joint according to claim 7, wherein in step S6, the length of the external thread tapped at the end of the stressed reinforcement is at least 50 mm.

* * * * *